United States Patent [19]

Michael

[11] 4,333,830

[45] Jun. 8, 1982

[54] VACUUM DRAIN SYSTEM

[75] Inventor: Harald Michael, Hamburg, Fed. Rep. of Germany

[73] Assignee: Electrolux GmbH, Hamburg, Fed. Rep. of Germany

[21] Appl. No.: 825,027

[22] Filed: Aug. 16, 1977

[30] Foreign Application Priority Data

Aug. 21, 1976 [DE] Fed. Rep. of Germany ..... 2637765

[51] Int. Cl.[3] ..... C02F 9/00

[52] U.S. Cl. ..... 210/170; 4/345; 137/205; 137/236 R

[58] Field of Search ..... 4/345, 431–433; 137/205, 236; 210/170

[56] References Cited

U.S. PATENT DOCUMENTS

| | | | |
|---|---|---|---|
| 2,271,480 | 1/1942 | Gibson et al. | 137/236 X |
| 3,211,167 | 10/1965 | Clift et al. | 210/170 X |
| 3,239,849 | 3/1966 | Liljendahl | 4/345 |
| 3,730,884 | 5/1973 | Burns et al. | 210/170 X |

*Primary Examiner*—Robert H. Spitzer

*Attorney, Agent, or Firm*—Larson and Taylor

[57] ABSTRACT

A vacuum drain system having alternating ascending and descending sections in a conduit for conveying a liquid, such as waste water, to a collector tank maintained under vacuum to induce liquid flow through the conduit. At least one of the descending conduit sections is of larger cross section than an adjacent ascending section to facilitate flow of liquid through the conduit.

7 Claims, 1 Drawing Figure

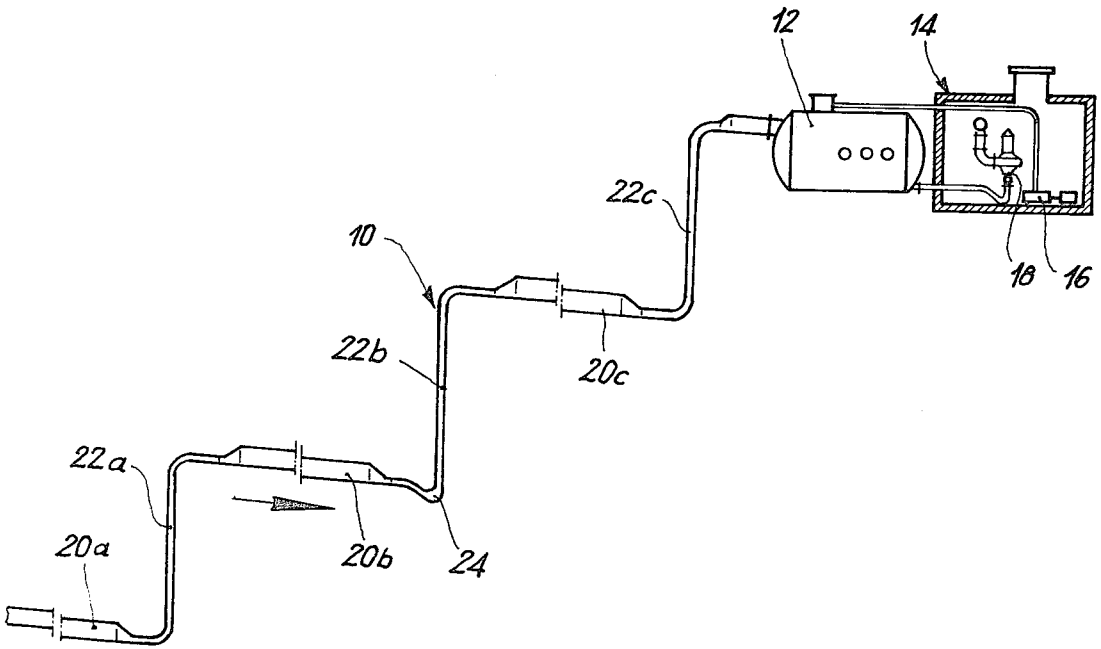
12
14
16
18
22c
20c
10
22b
24
20b
22a
20a

VACUUM DRAIN SYSTEM

The invention relates to a vacuum drain system, comprising at least one liquid collector conduit with sections alternatingly ascending and descending in the direction of flow, with a collecting tank that is under vacuum.

Vacuum conduits for liquids, such as waste water, with alternatingly ascending and descending conduit sections are known and described, for example, in U.S. Pat. No. 3,239,849, German Pat. No. 1,238,858, and German OS. No. 2,455,551, herein incorporated by reference. The or each collector conduit is connected to one or more plumbing drains or waste water drains such as a drain from a sink, water closet, bathtub, industrial effluent, etc. By this disposition of conduits, the water in the conduit collects as it drips in a descending section and forms water plugs that are driven further through the conduit when a plumbing drain connection is opened, because of the sucked-in air. In known systems, the succeeding conduit sections, independently of their incline, have substantially the same cross section whose size is calculated from the quantity of water to be transported. Here, in consideration of the high flow velocities and pipe friction losses, the effort was made to have the flow cross section as large as possible, but on the other hand, certain upper limits had to be respected in order to cause the air admitted in bursts into the conduit system, to thrust the water adhead of it and not simply pass through it.

The problem to which the invention is addressed is to create a vacuum drain system of the described type that functions more efficiently than known systems do. This problem is solved according to the invention in that at least one of the ascending conduit sections presents a substantially smaller cross section than that of an adjacent descending section.

By means of the invention, optimal adaptation of the conduit cross section to conduit function is attained. In the descending sections where the water flow can be well accelerated, a relatively large flow cross section is available, and friction losses are slight. In the ascending sections of the conduit the air primarily seeks to pass through the water, instead of pushing it on ahead. Here the proposed reduction of the conduit cross section ensures that the air will drive the water ahead of it. The stronger pipe friction in the ascending, narrower, conduit sections does not have much importance because these sections are relatively short in comparison to the whole length of the conduit.

In order to promote further the formation of a water plug at the transition between a descending and an ascending conduit section, there may be provision of a pocket-like depression at this point. The same purpose is served by connecting the ascending section to the descending section with the smaller cross section of the ascending section connected to the descending section off center to the lower portion of the cross section of the descending section.

The invention is discussed below with reference to the embodiment shown in the drawing.

The drawing shows, in a simplified way, one vacuum collector line, with ascending and descending conduit sections, leading to the system's vacuum facility.

The collector line of the drain system according to the invention, has been assigned numeral 10 as its overall designation. Through it, waste water from a plurality of plumbing drain connections is sucked to a collecting tank 12 of a vacuum facility 14 whose suction pump 16 maintains a specific reduced pressure in tank 12. From time to time the waste water collected in tank 12 is pumped off by another pump 18.

As the drawing shows, collecting conduit 10 comprises descending conduit sections 20*a, b, c* and ascending sections 22*a, b, c.* The descending sections each are inclined downwardly, in the direction of flow to tank 12, such that liquid flowing therein flows downwardly. The ascending sections each are inclined upwardly, in the direction of flow to tank 12, such that liquid flowing therethrough flows upwardly. Conduit sections 20*a, b, c,* depending upon design capacity, respectively, have an internal diameter of about 110 to 300 mm, whereas the ascending sections 22*a, b, c,* are made with a diameter of about 50 to 100 mm. The ratio of the cross section of a descending section to that of an ascending section is thus in the range of 6:1 to 1.1 to 1. The different cross section of the ascending and descending conduit sections is correlated to the differing tendency in the two sections, on the part of air that is admitted into the system in bursts, to pass through the water. The advantage of the better entrainment of the water in the ascending section outweighs the disadvantage of greater pipe friction because the ascending sections with narrower cross section are comparatively short with respect to the length of the entire conduit.

To promote plug formation by the water standing in the conduit, pocket-like depressions 24 can be made at the downstream ends of the descending conduit sections at the junction between the descending and the ascending conduit sections, as shown in the drawing, for example, between sections 20*b* and 22*b.* For the same purpose, the narrower sections are also not joined coaxially to the other sections, but rather are joined in an off center manner with the narrower ascending section connected to the lower portion of the larger cross section of an adjacent descending section.

The angle between the descending and the ascending sections depends upon local conditions, and may range between 3° and 90°.

What is claimed is:

1. An improved vacuum drain system comprising: a conduit adapted to be connected to a plurality of drain connections from which waste water is drained and comprising successively alternating sections which ascend and descend in the direction of flow through the conduit; a collector tank in fluid communication with said conduit for receiving liquid flowing therethrough; and suction means connected to said conduit for providing a vacuum in said collector tank to induce the flow of liquid through said conduit, at least one of said descending conduit sections having a substantially larger cross section than that of an adjacent ascending conduit section, the said adjacent ascending conduit section being located downstream of the said at least one descending conduit section in the direction of fluid flow and being directly connected thereto so that the entire amount of fluid flowing in the descending conduit section will also flow in the ascending conduit section.

2. An improved vacuum drain system according to claim 1 wherein the ratio of the cross section of said descending section to said adjacent ascending section is from 1.1:1 to 6:1.

3. An improved vacuum drain system according to claim 2 wherein the diameter of said descending section is about 110 to 300 mm and the diameter of said ascending section is about 50 to 100 mm.

4. An improved vacuum drain system according to claim 1 wherein the angle between adjacent ascending and descending conduit sections is from 3° to 90°.

5. An improved vacuum drain system according to claim 1 wherein a pocket-like depression for collection of liquid is provided at the downstream end of a descending conduit section at the juncture with an adjacent ascending conduit section.

6. An improved vacuum drain system according to claim 1 wherein an ascending conduit section is connected off center to the lower portion of the cross section of an adjacent descending conduit section.

7. An improved vacuum drain system according to claim 1 wherein a plurality of said descending conduit sections have a substantially larger cross section than that of both of the ascending conduit sections adjacent thereto.

* * * * *